US009207647B2

(12) United States Patent
Baloa Welzien et al.

(10) Patent No.: US 9,207,647 B2
(45) Date of Patent: Dec. 8, 2015

(54) PERSONAL ALARM SYSTEM

(75) Inventors: Leonardo Alberto Baloa Welzien, Lake Forest, CA (US); Michael Edward Colbaugh, Level Green, PA (US)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/006,526

(22) PCT Filed: Mar. 15, 2012

(86) PCT No.: PCT/IB2012/051240

§ 371 (c)(1), (2), (4) Date: Sep. 20, 2013

(87) PCT Pub. No.: WO2012/127374

PCT Pub. Date: Sep. 27, 2012

(65) Prior Publication Data

US 2014/0009282 A1 Jan. 9, 2014

Related U.S. Application Data

(60) Provisional application No. 61/467,155, filed on Mar. 24, 2011.

(51) Int. Cl.
*G08B 23/00* (2006.01)
*G04G 11/00* (2006.01)

(52) U.S. Cl.
CPC ..... *G04G 11/00* (2013.01)

(58) Field of Classification Search
CPC ..... A61B 3/113; A61B 2562/0233; A61B 3/132; A61B 3/11; G03F 7/70091; G08F 7/70058; A61N 1/3787; A61N 5/1064
USPC ..... 340/539.11, 539.12; 600/26, 27; 351/246; 250/200, 221
See application file for complete search history.

(56) References Cited

U.S. PATENT DOCUMENTS

| | | | | |
|---|---|---|---|---|
| 390,786 | A | 10/1888 | Lane | |
| 4,920,525 | A | 4/1990 | Meister | |
| 5,089,998 | A | 2/1992 | Rund | |
| 5,909,179 | A | 6/1999 | Hiltman | |
| 6,366,539 | B1 | 4/2002 | Liao | |
| 6,795,377 | B2 | 9/2004 | Gorden | |
| 7,248,915 | B2 | 7/2007 | Ronnholm | |
| 7,492,672 | B2 | 2/2009 | Cuisinier | |
| 7,727,139 | B2 * | 6/2010 | Topp et al. | 600/27 |
| 8,303,635 | B2 * | 11/2012 | Hurst | 607/88 |
| 8,562,659 | B2 | 10/2013 | Wells et al. | |
| 8,784,293 | B2 * | 7/2014 | Berka et al. | 600/26 |
| 2007/0002692 | A1 | 1/2007 | Van Brunt | |
| 2008/0170476 | A1 | 7/2008 | Hurst | |
| 2008/0262575 | A1 * | 10/2008 | Aunio et al. | 607/88 |
| 2010/0204754 | A1 * | 8/2010 | Gross et al. | 607/53 |

(Continued)

FOREIGN PATENT DOCUMENTS

| | | | |
|---|---|---|---|
| CN | 201418956 | Y | 3/2010 |
| DE | 202007015820 | U1 | 2/2008 |

(Continued)

*Primary Examiner* — Travis Hunnings

(57) ABSTRACT

A personal alarm system that only wakes up the intended user includes an appliance worn near the eye. The personal alarm system emits radiation of a particular wavelength onto the eye or eyelid of the intended user and a predetermined moment to wake up the intended user.

17 Claims, 6 Drawing Sheets

(56) References Cited

U.S. PATENT DOCUMENTS

| | | | | |
|---|---|---|---|---|
| 2012/0095534 | A1 | 4/2012 | Schlangen et al. | |
| 2012/0259410 | A1 * | 10/2012 | Gefen et al. | 623/6.11 |
| 2013/0053929 | A1 | 2/2013 | Colbaugh | |

FOREIGN PATENT DOCUMENTS

| | | | |
|---|---|---|---|
| WO | 2010076708 | A1 | 7/2010 |
| WO | 2010076710 | A1 | 7/2010 |
| WO | 2010122446 | A1 | 10/2010 |

* cited by examiner

PERSONAL ALARM SYSTEM

BACKGROUND

1. Field of the Invention

The present disclosure pertains to a personalized method and system for waking up a subject.

2. Description of the Related Art

Systems for waking up a user at a predetermined moment, such as an alarm clock, are commonplace. Such systems may produce a sound in order to wake up a user. If anyone else may also be awoken by the same sound, e.g. a person sleeping in proximity of the user, then such a system is not personalized.

SUMMARY

It is an object of one or more embodiments of the present disclosure to provide a personal alarm system configured to wake up a subject by emitting radiation onto an eye of the subject. The personal alarm system comprises an appliance configured to be worn near an eye of the subject; a radiation source carried by the appliance, wherein the radiation source is configured to emit radiation in a first wavelength band onto an eyelid of the subject wearing the appliance, wherein the first wavelength band is selected such that upon transmission through the eyelid of the subject the radiation will be perceived by the subject as light of a particular color; and a controller configured to control emission of radiation by the radiation source.

It is yet another aspect of one or more embodiments of the present disclosure to provide a personalized method of waking up a subject by emitting radiation onto an eyelid of the subject. The method comprises carrying a radiation source near an eye of the subject; determining that an eyelid of the subject is closed; and responsive to the determination that the eyelid of the subject is closed, emitting radiation, by the radiation source, in a first wavelength band onto the eyelid of the subject, wherein the first wavelength band is selected such that upon transmission through the eyelid of the subject the radiation will be perceived by the subject as light of a particular color.

It is yet another aspect of one or more embodiments to provide a personal system configured to wake up a subject by emitting radiation onto an eyelid of the subject. The system comprises means for carrying a radiation source near an eye of the subject; means for determining that the eyelid if the subject is closed; and means for emitting radiation responsive to the determination that the eyelid of the subject is closed, in a first wavelength band onto the eyelid of the subject, wherein the first wavelength band is selected such that upon transmission through the eyelid of the subject the radiation will be perceived by the subject as light of a particular color.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of any limits.

DETAILED DESCRIPTION OF EXEMPLARY EMBODIMENTS

Figure 1:
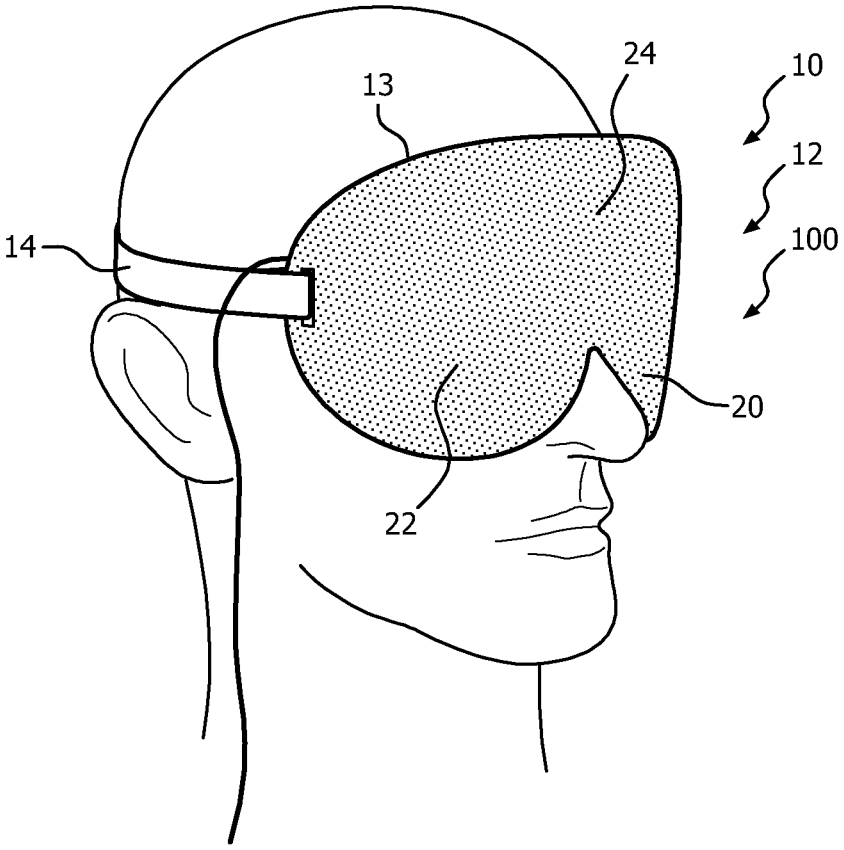
FIG. 1 illustrates a sleep mask configured to provide an alarm system to a subject, in accordance with one or more embodiments.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

Figure 2:
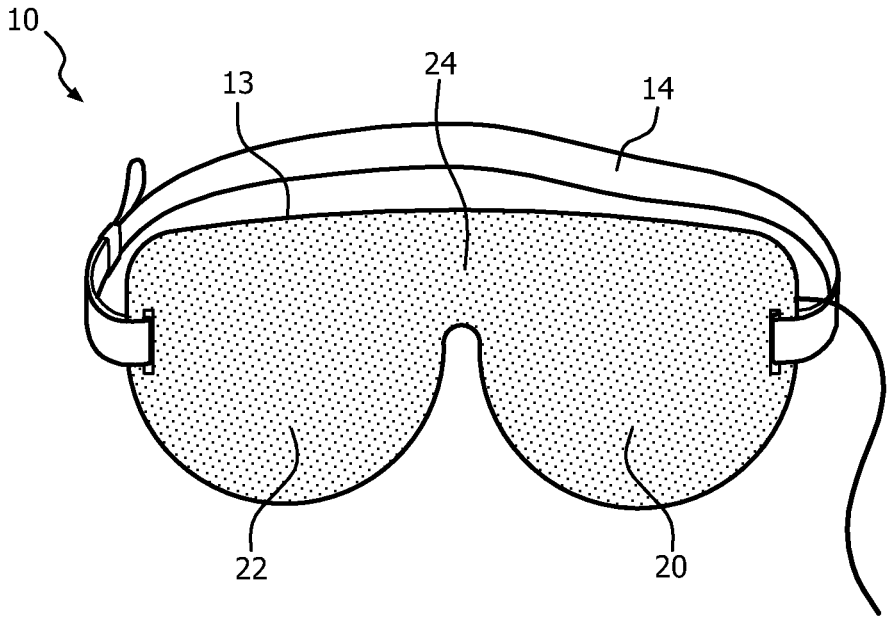
FIG. 2 illustrates a sleep mask configured to provide an alarm system to a subject, in accordance with one or more embodiments.
Figure 3:
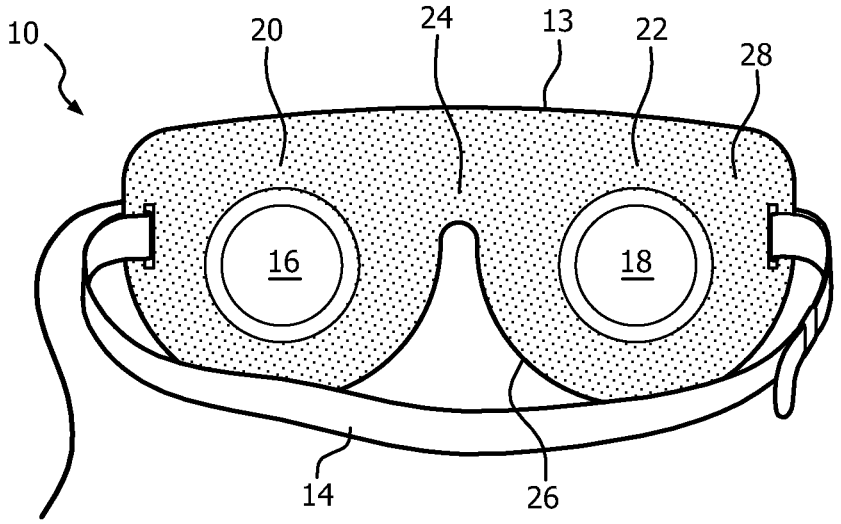
FIG. 3 illustrates a sleep mask configured to provide an alarm system to a subject, in accordance with one or more embodiments.

FIGS. 1-3 illustrate a sleep mask configured to provide a personal alarm system 100 to a subject, in accordance with one or more embodiments. Personal alarm system 100 is configured to wake up a subject (and no-one but the intended subject) at a predetermined moment by emitting radiation onto a closed eyelid of the sleeping subject. If multiple users sleep in close proximity, a personal alarm system can wake up one user without disturbing another (proximate) user. Personal alarm system 100 includes an appliance 10, a radiation source 30, and a processor/controller 78. In certain embodiments, personal alarm system 100 may include one or more of a sleep mask 12, a shield 13, a strap 14, a first lighting module 16, a second lighting module 18, an eyelid detector 41, and/or other components. Appliance 10 may be implemented as a sleep mask. For the purposes of this disclosure, the term "eyelid" may be considered part of the subject's "eye."

Appliance 10 is configured to be worn near an eye of the subject. In embodiments where appliance 10 is implemented as a sleep mask at least one of the constituent components of the sleep mask is configured to be worn near an eye of the subject. Near the eye means within 20 cm of the eye, within 3 inches of the eye, within one inch of the eye, within a range of 1 cm to 6 cm of the eye, within a range of 0.5 to 1.0 inch of some particular part of the eye, within 0.25 inch of the cornea, contacting the eyebrow of the subject, and/or contacting the eyelid of the subject. Appliance 10 is configured to carry radiation source 30 and/or a constituent component of personal alarm system 100 that is configured to include radiation source 30. For example, in certain embodiments, one or more lighting modules—such as lighting module 16 and/or lighting module 18—include one or more radiation sources 30. Radiation source 30 is configured to emit radiation in a first wavelength band onto or near a (closed) eyelid of the subject using personal alarm system 100, wherein the first wavelength band is selected such that upon transmission through the closed eyelid of the subject the radiation will be perceived by the subject as light of a particular color, e.g. white light or natural light.

Personal alarm system 100 may include an eyelid detector (see FIG. 4, item 41) configured to determine whether the eye of the subject is closed. Personal alarm system 100 may include a base station (see FIG. 4, item 42) configured to identify a wake-up moment (i.e. the predetermined moment) and, responsive to identification, to communicate (e.g. wirelessly) a control signal to a component of sleep mask 12 that causes initiation of emission of radiation in the selected first wavelength band. Alternatively, in certain embodiments, personal alarm system 100 lacks a base station and sleep mask 12 includes a component to identify a wake-up moment and initiate emission of radiation. By way of illustration, the lighting modules in FIG. 4 each comprise four radiation sources 30.

As can be seen in FIG. 1, personal alarm system 100 includes appliance 10, here implemented as a sleep mask 12, which includes a shield 13 configured to cover at least one eye of the subject wearing sleep mask 12. In certain embodiments, shield 13 includes a first shield portion 20 and a second shield portion 22. First shield portion 20 is configured to cover a first eye of the subject. Second shield portion 22 is configured to cover a second eye of the subject. In order to comfortably cover the first eye and the second eye of the subject, first shield portion 20 and second shield portion 22 are substantially larger than the ocular openings of the eyes of the subject.

In certain embodiments, first shield portion 20 and second shield portion 22 are joined by a connecting shield portion 24. Connecting shield portion 24 may be configured to rest on at least a portion of the nose of the subject (e.g., across the bridge of the nose) when the subject is wearing sleep mask 12. In some instances (not shown), connecting shield portion 24 may be narrower or thicker than the embodiment depicted in FIGS. 1-3.

In certain embodiments, shield 13 is formed from flexible materials. The flexibility of shield 13 may enhance the comfort of shield 13 to the subject. The side of shield 13 visible in FIG. 3 faces toward the subject during use. On this side, a base surface 26 substantially impermeable to liquids may be formed. For example, the impermeable base surface 26 may be formed by a flexible plastic material such as polycarbonate, polyester, and/or other materials. The impermeability of base surface 26 may protect electronic components of sleep mask 12 carried within shield 13 from moisture.

In certain embodiments, shield 13 includes a cushioning layer 28 disposed on base surface 26. Cushioning layer 28 is formed from a soft, resilient material. For example, cushioning layer 28 may be formed from foam, fabric, fabric/foam laminate, and/or other materials. During use, cushioning layer 28 provides the innermost surface to the subject, and engages the face of the subject. As such, the softness of cushioning layer 28 provides a cushion for the face of the subject, and enhances the comfort of sleep mask 12 to the subject.

As will be appreciated from the foregoing and FIGS. 1-3, during use shield 13 may provide a barrier between ambient radiation and an eye or the eyes of the subject. In certain embodiments, shield 13 is opaque, and blocks ambient radiation (at least within the visible spectrum), thereby shielding the eyes of the subject from ambient radiation.

Figure 6A:
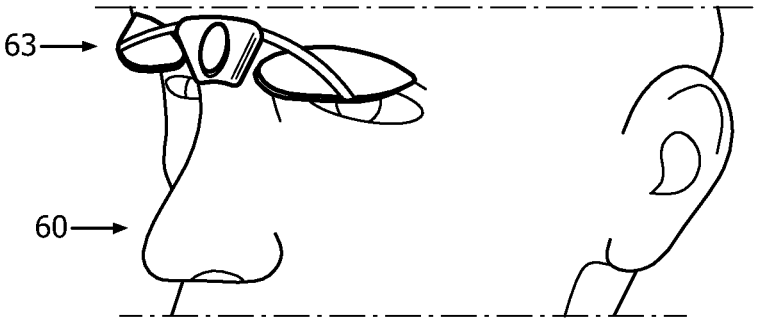
FIG. 6 illustrates variations for an appliance carrying a radiation source.
Figure 6B:
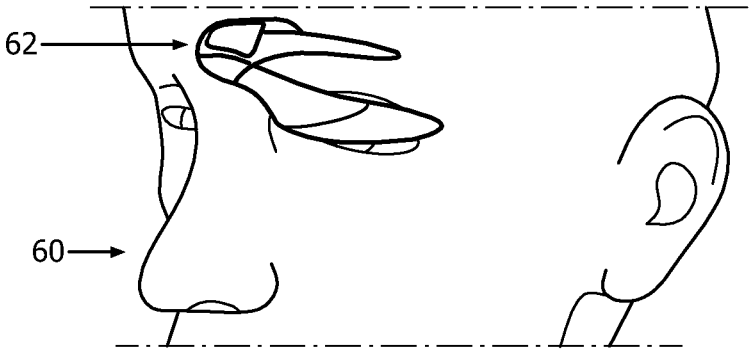
Figure 6C:
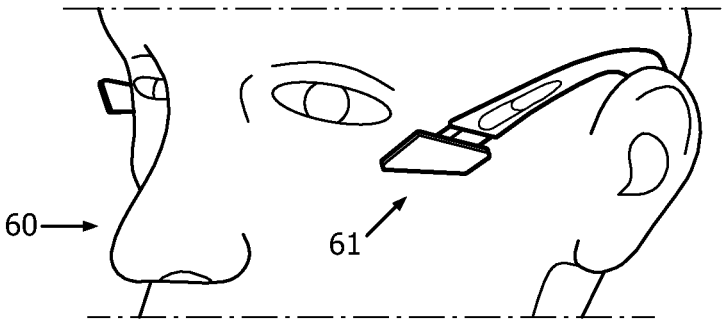

Strap 14 is configured to hold shield 13 in place on the subject. In the embodiments shown in FIGS. 1-3, strap 14 is attached to each of first shield portion 20 and second shield portion 22, and wraps around the head of the subject to hold sleep mask 12 in place on the head of the subject. Strap 14 may be adjustable in length (e.g., to accommodate different sized heads). Strap 14 may be formed from a resilient material (e.g., elastic) that stretches to accommodate the head of the user and holds shield 13 in place. It should be appreciated that the inclusion of strap 14 in the embodiments of sleep mask 12 illustrated in FIGS. 1-3 is not intended to be limiting. Other mechanisms for holding appliance 10 and/or shield 13 in place on the subject (on, near, around, and/or in one or both eyes) are contemplated. For example, a more elaborate headgear may be implemented (such as a full face-mask or an ear-mounted structure), an adhesive surface may be applied to shield 13 that removably adheres to the skin of the subject to hold or mount shield 13 in place (see e.g. FIG. 6B, in which an adhesive surface of mounting feature 62 removably adheres to the skin of subject 60), a rigid or flexible frame (such as eyeglasses or frames that similarly rest on the side of the face and/or the ears, see e.g. FIG. 6C, in which rigid frame 61 is worn by subject 60 in a manner that allows emission of radiation near the eye of subject 60), and/or other mechanisms for holding shield 13, lighting module 16, lighting module 18, radiation source(s) 30, and/or other components of appliance 10 in place may be implemented. See e.g. FIG. 6A, in which appliance 63 adheres to or is held onto the head of subject 60 around the eyes. In certain embodiments, such as illustrated in FIG. 6C, rigid frame 61 configured to carry a radiation source may not completely obscure the subject's vision.

Referring now to FIG. 3, first lighting module 16 and second lighting module 18 are mounted to first shield portion 20 and second shield portion 22, respectively, on the side of shield 13 that faces toward the face of the subject during use. First lighting module 16 and second lighting module 18 are backlit, and are configured to emit radiation onto the face of the subject on and/or about the eyes of the subject. The radiation emitted by first lighting module 16 and second lighting module 18 has a wavelength (or wavelengths, or wavelength band) that have an impact on the (sleeping) subject, when they are delivered in accordance with the intended operation of the present technology. In some instances, the radiation emitted by first lighting module 16 and second lighting module 18 is directed towards the eyes of the subject in radiation fields having relatively uniform luminance as perceived by the subject. For example, in one embodiment, the luminance of the radiation emitted by first lighting module 16 and second lighting module 18 varies across the respective emitted fields by an amount that is less than or equal to about 100:1 for use with eyes open, and less than 10,000:1 for eyes-closed applications. The size of the uniform field of radiation formed by either first lighting module 16 or second lighting module 18 may correspond to the size of the eye of the subject. Radiation from radiation source(s) 30 may be guided through a (waveguide) layer and/or module that diffuses, directs, (optionally/temporarily) blocks, and/or filters the radiation before it reaches the subject.

An example of a sleep mask implementing one or more stated functions of sleep mask 12 is disclosed in U.S. Patent Application 61/141,289, titled "System and Method for Administering Light Therapy", filed Dec. 30, 2008, which is hereby incorporated by reference herein in its entirety.

The wake-up moment may be a fixed time of day, e.g. 7:00 am, or a predetermined moment related to the sleeping pattern of the subject, e.g. completion of REM sleep, a predetermined combination, e.g. 30 minutes after completion of REM sleep, and/or another predetermined moment. Appliance 10 may optionally include a REM detection module configured to determine REM sleep and its completion, e.g. by detecting motion of the cornea of a subject underneath the surface of a closed eyelid. Such motion may e.g. be detected by analyzing reflected light off of the surface of the closed eyelid. Other ways to detect eye movement and/or (relative) distance to a certain constituent part of the eye may be used to detect REM motions, and thus the progression of REM sleep and/or other known patterns during sleep. The operation of personal alarm system 100, including the identification of a wake-up moment, may be based on such detected motion or progression, optionally in conjunction with physiological parameters such as may be derived from EEG measurements, EMG measurements, respiration measurements, cardiovascular measurements, HRV measurements, ANS measurements, and/or other measurements.

Radiation source(s) 30 may comprise light emitting diodes ("LEDs"), or other directional radiation source that emit radiation in a directed beam. Radiation source(s) 30 are configured to emit radiation having a wavelength (or wavelengths, or wavelength band) that is perceptible through a closed eyelid. Radiation that is perceived as white light or natural light may be more effective, efficient, and/or comfortable to wake up the subject than other colors. The color of the radiation may be perceived differently by an open eye of the same subject, when the radiation does not go through the eyelid of the subject. Whether the subject's vision is darkness-adapted may also be a factor in the subject's perception. Radiation source(s) 30 may produce an illuminance level of 15 to 20 lux, approximately 20 lux, 20 to 30 lux, less than 50 lux, less than 500 lux, and/or other illuminance levels. At certain wavelengths or in certain wavelength bands such a level of illuminance may be inadequate to reliably wake up an average user of a personal alarm system. At the selected wavelength or wavelength band, this level of illuminance is perceived through the closed eyelid as a light of a particular color, having much greater illuminance. The perceived light of a particular color may be white light or natural light. The color and intensity perceived by the subject being awoken during operation of personal alarm system 100 may differ markedly from the color and intensity perceived by the awake subject, or by the subject no longer having darkness-adapted vision.

Figure 5:
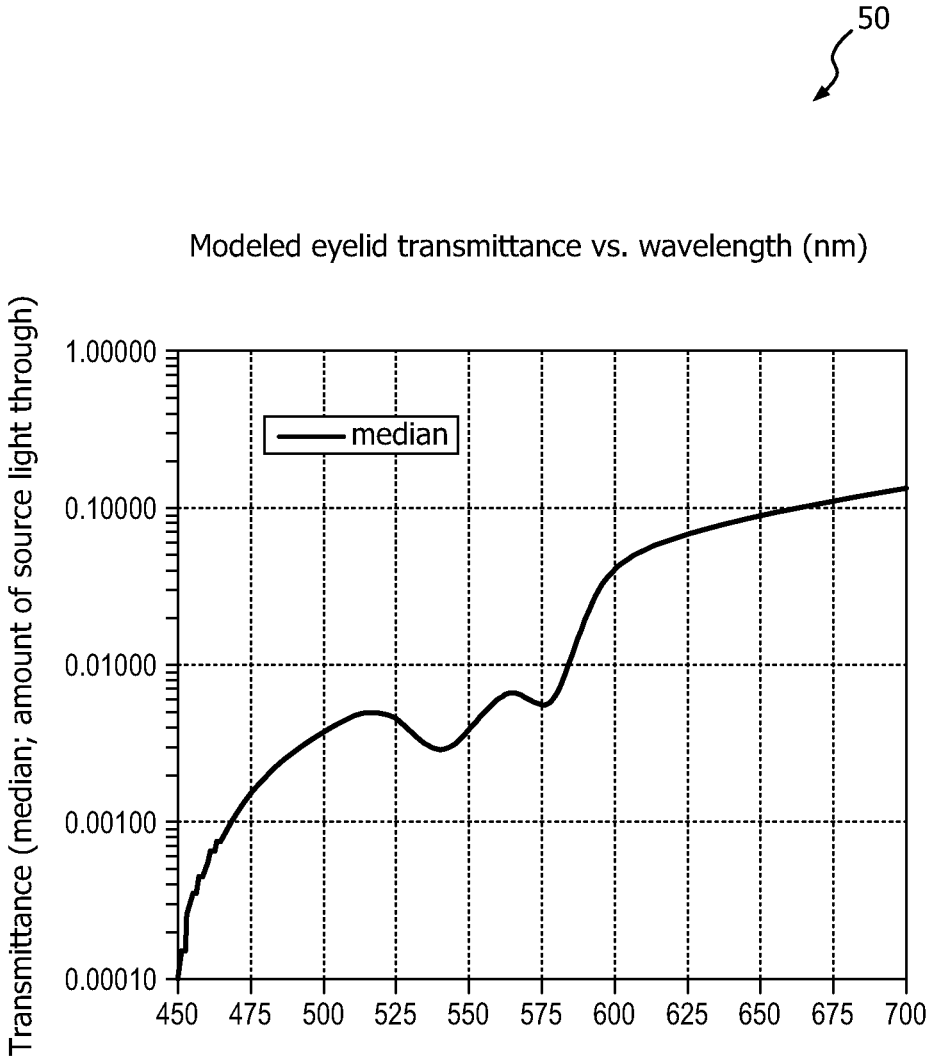
FIG. 5 illustrates a plot of transmittance of the human eyelid (on a logarithmic scale) versus wavelength.

By way of illustration, FIG. 5 illustrates through curve 50 that radiation below a wavelength of approximately 590 nm exhibit a markedly lower transmittance through a closed eyelid than a wavelength of over 600 nm. Furthermore, the perception of the radiation's brightness for a subject during scotopic vision changes markedly across the range of wavelengths between 550 nm and 675 nm. Radiation using a wavelength band between 590 nm and 630 nm may be perceived as a bright white light for a subject during scotopic vision through a closed eyelid, though the same radiation may be perceived as a much dimmer red light to an open eye and/or during photopic vision. Certain embodiments may use a wavelength in the range of visible light, in the range of invisible light which is converted to a visible light (such as by phosphorescence), a wavelength having substantial power in visible wavelengths greater than 500 nm, a wavelength having substantial power in visible wavelengths greater than 550 nm, a wavelength having substantial power in visible wavelengths greater than 590 nm, a wavelength having substantial power in visible wavelengths between 590 nm and 675 nm, a wavelength having substantial power in visible wavelengths between 590 nm and 630 nm, a wavelength having substantial power in 624 nm, wavelengths used by a plurality of relatively monochromatic radiation sources inside any of the stated wavelengths and wavelength bands in the present specification, time-varying patterns of radiation used to wake the subject, alter a sleep stage, and/or cause relaxation, and/or other wavelengths.

Once emission of radiation is initiated, the radiation may follow a pattern or sequence whereby different LEDs within a lighting module use different wavelengths, different wavelength bands, different levels of illuminance, or any (sequential) combination thereof. For example, the level of illuminance may be gradually increased to gently wake up the subject. As another example, the perceived color may be gradually changed to mimic a sunrise, or another sequence of perceived colors. Since humans evolved to be naturally awoken by sunlight, using radiation that appears to have a similar color may be suitable for a personal alarm system.

Personal alarm system 100 may include a sensor or module 41 to measure when the closed eye is opened, when the mask is taken off, whether the subject's vision is no longer scotopic, and/or when the subject is awake. Either circumstance (or any combination thereof) may be a justification to turn off the radiation source(s) for any lighting modules in use, and/or change any other operating parameter of personal alarm system 100.

Figure 4:
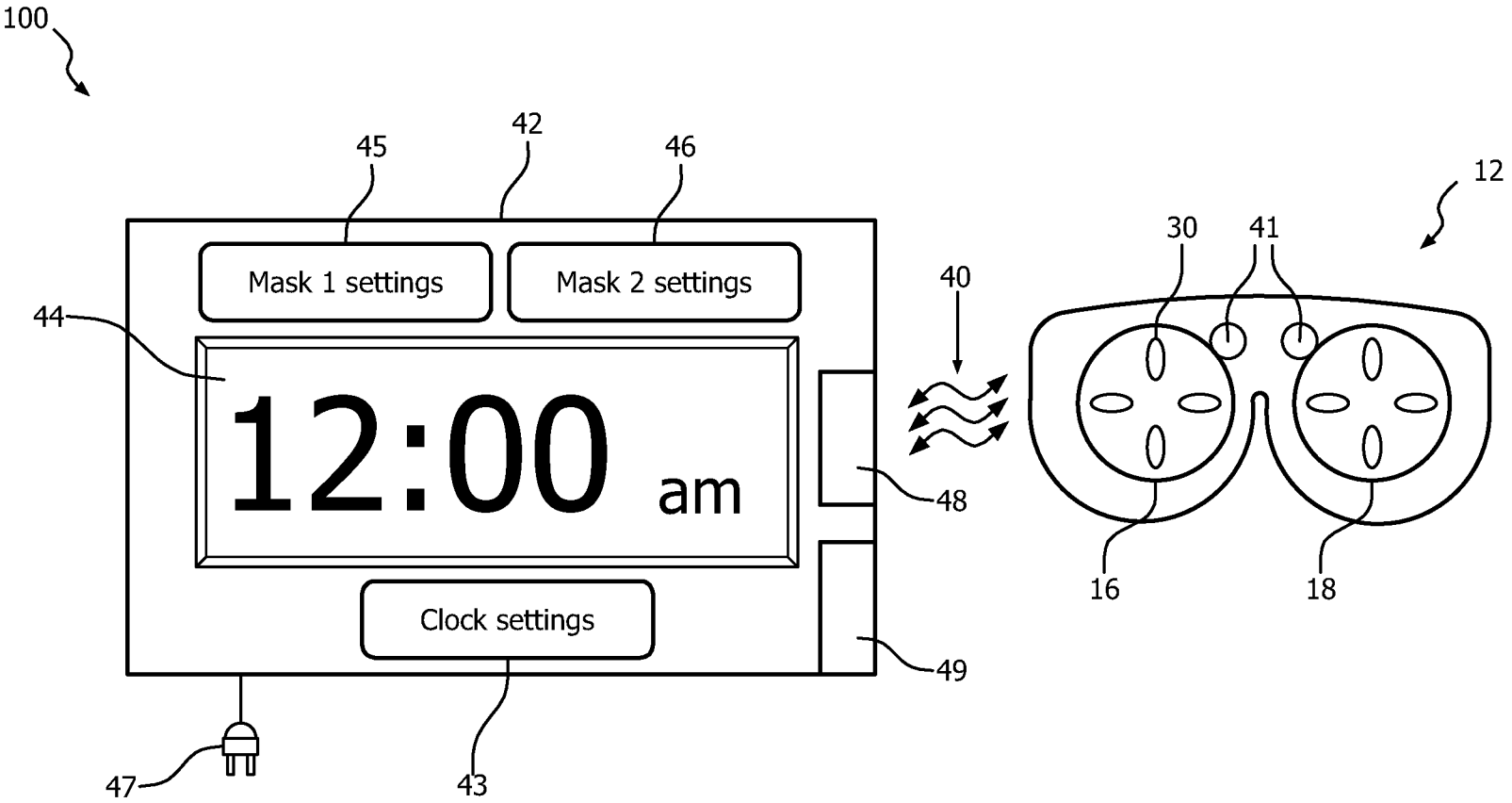
FIG. 4 illustrates a sleep mask and a base station in accordance with one or more embodiments.

FIG. 4 illustrates a sleep mask and a base station in accordance with one or more embodiments. In FIG. 4, sleep mask 12 communicates wirelessly (indicated by item 40) with base station 42. Wireless communication, as well as the use of a portable power source for sleep mask 12, may obviate the need for wires that connect sleep mask 12 to either a base station or a power source. Base station 42 includes one or more of a clock 44, clock settings interface 43, mask 1 settings interface 45, mask 2 settings interface 46, a wireless interface 48, a power plug 47, one or more sleep mask charging stations 49, and/or other components. Clock 44 may indicate the current time and/or be used to program a wake-up time for a sleep mask. Clock settings interface 43 may be used to program the current time, and/or set or change any other clock settings. In the example of FIG. 4, two sleep masks are associated with base station 42, though other implementations may allow one, three, or more such associations. Note that only one associated sleep mask, sleep mask 12, is shown in FIG. 4. Mask 1 settings interface 45 may be used to set the wake-up moment for the first sleep mask associated with base station 42 of FIG. 4, and/or set or change other settings related to the first sleep mask. Mask 2 settings interface 46 may be used to set the wake-up moment for the second sleep mask (not shown) associated with base station 42 of FIG. 4, and/or set or change other settings related to the second sleep mask. Wireless interface 48 provides the communication capability of base station 42 with any associated sleep masks, e.g. though radio communication, optical communication, audio communication, and/or other wireless communication. Sleep mask charging station 49 may be used to charge one or more sleep masks, e.g. during the day.

Figure 7:
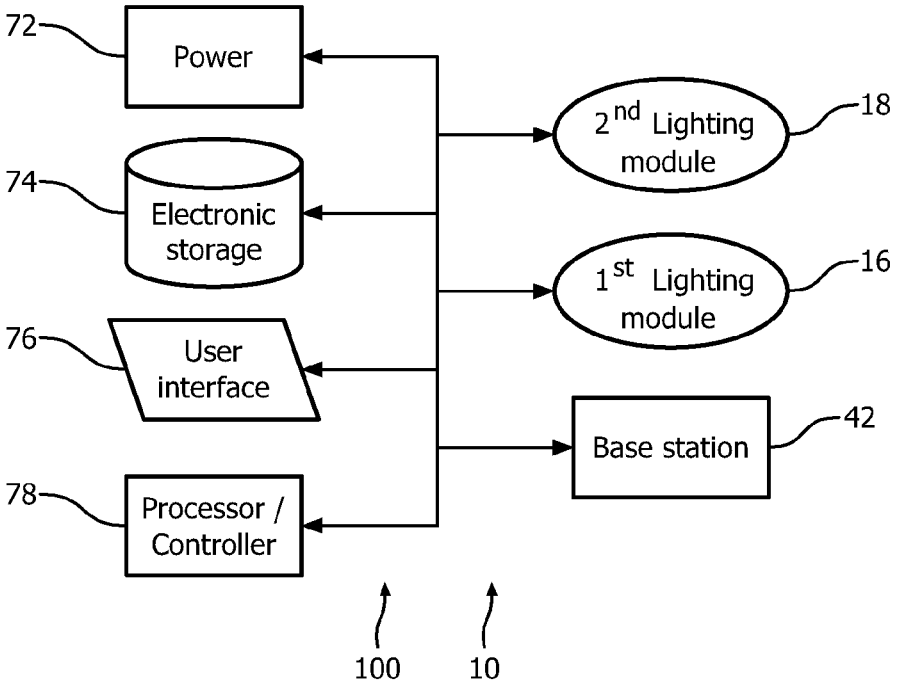
FIG. 7 schematically illustrates the components of an alarm system according to one or more embodiments.

FIG. 7 schematically illustrates the components of an alarm system according to one or more embodiments. As can be seen in FIG. 7, in addition to one or more of the components shown in FIGS. 1-3 and described above, personal alarm system 100 may include one or more of a power source 72, electronic storage 74, a user interface 76, and/or a processor/controller 78 (with regard to FIG. 7 referred to as processor 78). In one embodiment, one or more of power source 72, electronic storage 74, user interface 76, and/or processor 78 are carried on shield 13 and/or strap 14 of sleep mask 12. In this embodiment, one or more of power source 72, electronic storage 74, user interface 76, and/or processor 78 may be removably attached to shield 13 and/or strap 14, and may be disconnectable from the rest of sleep mask 12. This will enable power source 72, electronic storage 74, user interface 76, and/or processor 78 to be removed from a given shield 13 and/or strap 14, and attached to another shield 13 and/or strap 14, which may be beneficial if shield 13 and/or strap 14 degrade over time and/or with usage and must be replaced. Similarly, in one embodiment, first lighting module 16 and second lighting module 18 are also removable/replaceable on shield 13. Power source 72, electronic storage 74, user interface 76, and/or processor 78 may control operation the radiation sources associated with first lighting module 16 and/or second lighting module 18, as is discussed below.

Power source 72 provides the power necessary to operate the radiation sources associated with first lighting module 16 and second lighting module 18, and/or to power electronic storage 74, user interface 76, and/or processor 78. Power source 72 may include a portable source of power (e.g., a battery, a fuel cell, etc.), and/or a non-portable source of power (e.g., a wall socket, a large generator, etc.). In one embodiment, power source 72 includes a portable power source that is rechargeable. In one embodiment, power source 72 includes both a portable and non-portable source of power, and the subject is able to select which source of power should be used to provide power to appliance 10, sleep mask 12 and/or personal alarm system 100. In certain embodiments, base station 42 may be configured to recharge one or more sleep masks. Note that base station 42 may be powered separately from sleep mask 12 and its constituent components. The level of power required to operate sleep mask 12 depends in part of the level of illuminance used for radiation source(s) 30. Lower required power levels may correspond to smaller and/or cheaper batteries. By carefully selecting the wavelength or band of wavelengths used in lighting modules by radiation source(s) 30, a low level of illuminance and thus power, e.g. 20 to 30 lux which may correspond to approximately 50 mW using certain types of LEDs, may be adequate to reliably wake up an average user of a personal alarm system. Personal alarm system 100, and particularly sleep mask 12, thus provide an energy-efficient way to wake up a sleeping subject.

In one embodiment, electronic storage 74 comprises electronic storage media that electronically stores information. The electronic storage media of electronic storage 74 may include one or both of system storage that is provided integrally (i.e., substantially non-removable) with personal alarm system 100 and/or removable storage that is removably connectable to personal alarm system 100 via, for example, a port (e.g., a USB port, a FireWire port, etc.) or a drive (e.g., a disk drive, etc.). Electronic storage 74 may include one or more of optically readable storage media (e.g., optical disks, etc.), magnetically readable storage media (e.g., magnetic tape, magnetic hard drive, floppy drive, etc.), electrical charge-based storage media (e.g., EPROM, EEPROM, RAM, etc.), solid-state storage media (e.g., flash drive, etc.), and/or other electronically readable storage media. Electronic storage 74 may store software algorithms, information determined by processor 78, information received via user interface 76, and/or other information that enables personal alarm system 100 to function properly. For example, electronic storage 74 may record or store one or more (sleeping) parameters (as discussed elsewhere herein), and/or other information. Electronic storage 74 may be a separate component within personal alarm system 100, or electronic storage 74 may be provided integrally with one or more other components of personal alarm system 100 (e.g., processor 78).

User interface 76 is configured to provide an interface between personal alarm system 100 and/or appliance 10 and a user through which the user can provide and/or receive information. This enables data, results, and/or instructions and any other communicable items, collectively referred to as "information," to be communicated between the user and personal alarm system 100. An example of information that may be conveyed to a subject is the current time, or the scheduled wake-up time. Examples of interface devices suitable for inclusion in user interface 76 include a keypad, buttons, switches, a keyboard, knobs, levers, a display screen, a touch screen, speakers, a microphone, an indicator light, an audible alarm, and a printer. Information may be provided to the subject by user interface 76 in the form of auditory signals, visual signals, tactile signals, and/or other sensory signals.

By way of non-limiting example, user interface 76 may include a radiation source capable of emitting light. The radiation source may include, for example, one or more of at least one LED, at least one light bulb, a display screen, and/or other sources. User interface 76 may control the radiation source to emit light in a manner that conveys to the subject information related to operation of personal alarm system 100. Note that the subject and the user of personal alarm system 100 may be one and the same person.

It is to be understood that other communication techniques, either hard-wired or wireless, are also contemplated herein as user interface 76. For example, in one embodiment, user interface 76 may be integrated with a removable storage interface provided by electronic storage 74. In this example, information is loaded into personal alarm system 100 from removable storage (e.g., a smart card, a flash drive, a removable disk, etc.) that enables the user(s) to customize the implementation of personal alarm system 100. Other exemplary input devices and techniques adapted for use with personal alarm system 100 as user interface 76 include, but are not limited to, an RS-232 port, RF link, an IR link, modem (telephone, cable, Ethernet, internet or other). In short, any technique for communicating information with personal alarm system 100 is contemplated as user interface 76

Processor 78 is configured to provide information processing and/or system control capabilities in personal alarm system 100. As such, processor 78 may include one or more of a digital processor, an analog processor, a digital circuit designed to process information, an analog circuit designed to process information, a state machine, and/or other mechanisms for electronically processing information. In order to provide the functionality attributed to processor 78 herein, processor 78 may execute one or more modules. The one or more modules may be implemented in software; hardware; firmware; some combination of software, hardware, and/or firmware; and/or otherwise implemented. Although processor 78 is shown in FIG. 7 as a single entity, this is for illustrative purposes only. In some implementations, processor 78 may include a plurality of processing units. These processing units may be physically located within the same device (e.g., sleep mask 12), or processor 78 may represent processing functionality of a plurality of devices operating in coordination.

In one embodiment, processor 78 controls first lighting module 16 and second lighting module 18 in accordance with one or more embodiments. Processor 78 may dictate the timing, the intensity, and/or the wavelength of the radiation emitted by first lighting module 16 and second lighting module 18 toward the face of the subject on or about the eyes of the subject. In one embodiment, the predetermined light therapy algorithm is stored in electronic storage 74, and is provided to processor 78 for execution via control of first lighting module 16 and second lighting module 18. In some instances, one or more aspects of the operation of personal alarm system 100 may be adjusted or customized for the subject. Adjustments and/or customizations may be input to appliance 10 via user interface 76. In one embodiment, electronic storage 74 stores a plurality of different wake-up patterns, and the subject (and/or a caregiver) select the appropriate pattern for the subject via user interface 76.

As was mentioned above, in certain embodiments, a wake-up pattern may dictate the timing of the administration of radiation to the subject by personal alarm system 100. As such, in this embodiment, processor 78 includes a clock. The clock may be capable of monitoring elapsed time from a given event and/or of monitoring the time of day. The subject (and/or a caregiver) may be enabled to correct the time of day generated by the clock of processor 78 via, for example, user interface 76. The wake-up pattern may include gradually incrementing the level of illuminance (or radiation intensity) over time, e.g. based on the clock. For example, the level of illuminance could be increased every minute (capped by a maximum level of illuminance) until the subject wakes up. The wake-up pattern may similarly change the wavelength of the radiation over time, e.g. based on the clock. In certain embodiments, the wake-up pattern may alternate between two or more levels of illuminance and/or wavelengths used, e.g. based on the clock, to produce an effect perceived as flashing lights and/or oscillating lights. By alternating multiple times per second, certain wake-up patterns may produce an effect perceived as a strobe light. Furthermore, multiple wake-up patterns may be combined in some sequence to wake of the subject. Certain embodiments may implement a snooze-function that allows a brief grace period (e.g. a few minutes) after initiating emission of radiation to wake up a subject. After the grace period, if still needed, another wake-up pattern may be used, e.g. a wake-pattern that produces an effect perceived as a flashing light or strobe light.

Figure 8:
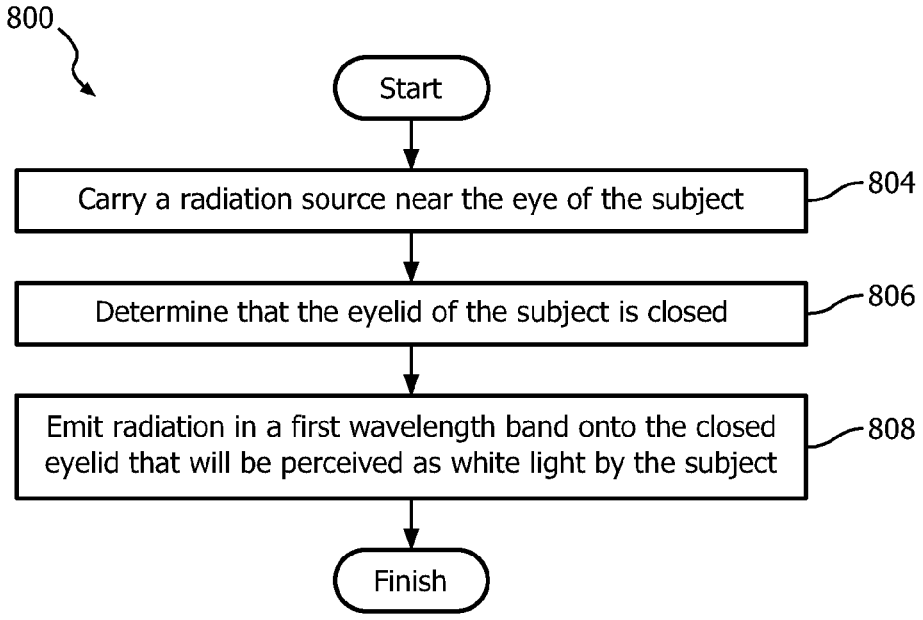
FIG. 8 illustrates a method of waking up a subject by emitting radiation onto a closed eyelid of the subject, according to one or more embodiments.

FIG. 8 illustrates a method 800 for waking up a subject by emitting radiation onto the eye of the subject. The operations of method 800 presented below are intended to be illustrative. In some embodiments, method 800 may be accomplished with one or more additional operations not described, and/or without one or more of the operations discussed. Additionally, the order in which the operations of method 800 are illustrated in FIG. 8 and described below is not intended to be limiting.

In some embodiments, method 800 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 800 in response to instructions stored electronically on an electronic storage medium. The one or more processing devices may include one or more devices configured through hardware, firmware, and/or software to be specifically designed for execution of one or more of the operations of method 800.

At an operation 804, a radiation source is carried near the eye of a subject. In one embodiment, operation 804 is performed by a shield of a sleep mask similar to or substantially the same as shield 13 (shown in FIG. 1 and described above). In certain embodiments, operation 804 is performed by a lighting module of a sleep mask similar to or substantially the same as lighting module 16 (or 18, both shown in FIG. 4 and described above).

At an operation 806, it is determined whether the eyelid of the subject is closed. In one embodiment, operation 806 is performed by an eyelid detector similar to or substantially the same as eyelid detector 41 (shown in FIG. 4 and described above).

At an operation 808, radiation is emitted in a first wavelength band onto the closed eyelid, wherein the radiation will be perceived as light of a particular color by the subject. In one embodiment, operation 808 is performed by a radiation source similar to or substantially the same as radiation source 30 (shown in FIG. 4 and described above).

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the embodiments have been described in detail for the purpose of illustration based on what is currently considered to be most practical and preferred, it is to be understood that such detail is solely for that purpose and that the disclosure is not limited to the disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

The invention claimed is:

1. A personal alarm system configured to wake up a subject by emitting radiation onto an eyelid of the subject, the personal alarm system comprising:

an appliance configured to be worn near an eye of the subject, wherein the eye includes an eyelid;

a radiation source carried by the appliance, wherein the radiation source is configured to emit radiation in a first wavelength band onto the eye of the subject wearing the appliance, wherein the first wavelength band includes visible wavelengths greater than about 590 nm, wherein the first wavelength band is selected such that upon transmission through the eyelid of the subject the radiation will be perceived by the subject as light of a particular color;

a controller configured to control emission of radiation by the radiation source; and an eyelid detector operatively connected with said controller and configured to determine whether the eye of the subject is closed, wherein the controller controls the radiation source based upon signals from the eyelid detector to emit radiation onto the closed eyelid of the eye of the subject and cease emitting radiation responsive to the eyelid being open.

2. The personal alarm system of claim 1, wherein the appliance includes a sleep mask.

3. The personal alarm system of claim 1, wherein the perceived light of a particular color is white light.

4. The personal alarm system of claim 1, further comprising:

a base station configured to identify a wake-up moment and, responsive to identification of a wake-up moment, to communicate a control signal to the controller of the appliance that causes the controller to initiate emission of radiation by the radiation source in the first wavelength band.

5. The personal alarm system of claim 1, wherein the first wavelength band ranges from approximately 590 nm to approximately 630 nm.

6. The personal alarm system of claim 1, wherein the first wavelength band is selected based on differences in perceived illumination levels between scotopic vision and photopic vision.

7. The personal alarm system of claim 1, wherein the appliance comprises a shield configured to cover the eye of the subject wearing the appliance such that the shield provides a barrier between ambient light and the eye of the subject.

8. A method of waking up a subject by emitting radiation onto a closed eyelid of the subject, the method comprising;

carrying a radiation source near an eye of the subject;

determining whether an eyelid of the subject is closed;

responsive to a determination that the eyelid of the subject is closed, emitting radiation, by the radiation source, in a first wavelength band onto the closed eyelid of the subject, wherein the first wavelength band includes visible wavelengths greater than about 590 nm, wherein the first wavelength band is selected such that upon transmission through the closed eyelid of the subject the radiation will be perceived by the subject as light of a particular color;

determining whether the eyelid of the subject is open; and responsive to the eyelid of the subject being open, cease emitting the radiation.

9. The method of claim 8, further comprising:

identifying a wake-up moment; and responsive to identification of the wake-up moment, communicating a control signal that causes initiation of the emission of the radiation in the first wavelength band by the radiation source.

10. The method of claim 8, wherein the first wavelength band ranges from approximately 590 nm to approximately 630 nm.

11. The method of claim 8, wherein the first wavelength band is selected based on differences in perceived illumination levels between scotopic vision and photopic vision.

12. The method of claim 8, wherein the appliance comprises a shield configured to cover the eye of the subject such that the shield provides a barrier between ambient light and the eye of the subject.

13. A system configured to wake up a subject by emitting radiation onto a closed eyelid of the subject, the system comprising:

means for carrying a radiation source near an eye of the subject;

means for determining whether the eyelid of the subject is closed;

means for emitting radiation, responsive to a determination that the eyelid of the subject is closed, in a first wavelength band onto the closed eyelid of the subject, wherein the first wavelength band includes visible wavelengths greater than about 590 nm, wherein the first wavelength band is selected such that upon transmission through the closed eyelid of the subject the radiation will be perceived by the subject as light of a particular color;

means for determining whether the eyelid of the subject is open; and means for ceasing the emitting of the radiation in response to the eyelid being determined to be open.

14. The system of claim 13, further comprising:

means for identifying a wake-up moment; and means for communicating, responsive to identification of the wake-up moment, a control signal that causes initiation of the emission of the radiation in the first wavelength band by the means for emitting radiation.

15. The system of claim 13, wherein the first wavelength band ranges from approximately 590 nm to approximately 630 nm.

16. The system of claim 13, wherein the first wavelength band is selected based on differences in perceived illumination levels between scotopic vision and photopic vision.

17. The system of claim 13, wherein the appliance comprises:

means for covering the eye of the subject to provide a barrier between ambient light and the eye of the subject.

* * * * *